US009406179B2

(12) United States Patent
Ayeva et al.

(10) Patent No.: US 9,406,179 B2
(45) Date of Patent: Aug. 2, 2016

(54) METHOD FOR PROCESSING A PRESENCE SIGNAL IN A HANDS-FREE VEHICLE ACCESS SYSTEM HAVING CAPACITIVE SENSORS

(71) Applicants: Bachir Ayeva, Toulouse (FR); Thierry Belleza, Castelnau d'Estretefonds (FR); Isabelle Verdon, Cornebarrieu (FR)

(72) Inventors: Bachir Ayeva, Toulouse (FR); Thierry Belleza, Castelnau d'Estretefonds (FR); Isabelle Verdon, Cornebarrieu (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 120 days.

(21) Appl. No.: 14/308,883

(22) Filed: Jun. 19, 2014

(65) Prior Publication Data

US 2015/0002263 A1 Jan. 1, 2015

(30) Foreign Application Priority Data

Jun. 28, 2013 (FR) ..... 13 56259

(51) Int. Cl.
*G07C 9/00* (2006.01)

(52) U.S. Cl.
CPC ..... *G07C 9/00111* (2013.01); *G07C 9/00309* (2013.01); *G07C 2009/00793* (2013.01); *G07C 2209/61* (2013.01); *G07C 2209/65* (2013.01)

(58) Field of Classification Search
None
See application file for complete search history.

(56) References Cited

U.S. PATENT DOCUMENTS 6,552,649 B1 4/2003 Okada et al.
6,812,823 B2 * 11/2004 Inaba ..... B60R 25/00 340/5.6
7,819,442 B2 * 10/2010 Ieda ..... B60R 25/24 292/336.3
7,868,746 B2 * 1/2011 Richter ..... B60R 25/246 307/10.1
8,854,114 B2 * 10/2014 Tabata ..... H03K 3/01 327/517
9,057,210 B2 * 6/2015 Dumas ..... G07C 9/00571
2007/0126246 A1 6/2007 Suzuki et al.
2009/0284358 A1 11/2009 Ieda et al.
2012/0249291 A1 10/2012 Holcomb et al.
2014/0240088 A1 * 8/2014 Robinette ..... G08B 13/1427 340/5.61

FOREIGN PATENT DOCUMENTS

FR 2 915 838 11/2008
FR 2 931 982 12/2009
WO 2008/135134 11/2008

OTHER PUBLICATIONS

French Search Report dated Mar. 20, 2014 in corresponding French priority application.

* cited by examiner

*Primary Examiner* — Brian Miller
(74) *Attorney, Agent, or Firm* — Young & Thompson

(57) ABSTRACT

Method for processing a presence signal in a hands-free vehicle access system having capacitive sensors. After starting steps constituted by nominal operation, switching to low-energy consumption mode, and switching to polling of an interrogation signal at nominal frequency, this method includes: presence testing with nominal polling; requesting the identity of the electronic key, transmitted via a central unit; detecting the presence of a hand on a handle transmitted via a capacitive sensor to the central unit; and authorizing the unlocking of the vehicle. The method includes a step of reducing the frequency of signals transmitted by the antenna of the central unit so as to switch into a "slow polling" test, such that the capacitive sensors have sufficient time intervals to test the central unit for the presence of a hand during the information step. The capacitive sensors then have greater availability to signal the presence of a hand.

16 Claims, 3 Drawing Sheets

METHOD FOR PROCESSING A PRESENCE SIGNAL IN A HANDS-FREE VEHICLE ACCESS SYSTEM HAVING CAPACITIVE SENSORS

BACKGROUND OF THE INVENTION

The invention relates to a method for processing a presence signal in a hands-free vehicle access system equipped with capacitive sensors. A hands-free access system performs a series of functions for the comfort of the driver or owner of the vehicle. It results in a pleasant or "magical" effect: when one of the electronic keys authorized to open this vehicle approaches said vehicle a series of signals are transmitted by the vehicle, referred to as welcome signals, and the doors of this vehicle are unlocked immediately. A further function is subsequently added to these two first functions: it is possible to start the vehicle whilst the electronic key remains in a pocket or bag. A final function added to these three first functions lies in confirming the request to unlock the door with the supplementary use of sensors that detect the presence of a hand held on the handle of the vehicle and thus detect the intention of the owner to access his vehicle.

This type of hands-free access generally functions by means of radio communications between a central unit installed in the vehicle and the electronic key as well as wired communications between presence sensors (for detection of a hand on a vehicle handle) and the central unit. The radio communications are in the low-frequency range, for example 125 kHz, for the emission from the central unit to the electronic key and are in the radio frequency range, for example 433 MHz or 315 MHz, for the emissions from the electronic key to the vehicle.

In general, the presence sensors are installed in the handles of the openings (door or lid of the luggage compartment) of a vehicle, the handles also each accommodating a radio frequency antenna for receiving signals originating from the electronic key and destined for the central unit. The electronic keys are also equipped with transmitting/receiving radio frequency antennas in order to communicate with the radio frequency antennas of the central unit.

The hands-free access as exists today thus comprises the joint use of presence sensors for detecting a hand held on a handle and the remote recognition of the electronic key via radio communications.

This operating principle is described in particular in patent document US 2012/0249291, which proposes the joint use of radio communications and infrared sensors, with the following exemplary embodiment. The vehicle awaiting the arrival of an authorized key verifies the arrival of this key via interrogations transmitted via radio. When the approach of a key is confirmed, the sensors await the detection of a hand. If the detection of the hand meets certain requested conditions, and if the key remains in the vicinity of the vehicle, the unlocking of the doors is authorized.

This method has the disadvantage of requiring the use of infrared sensors. These sensors are not very reliable, since it is imperative that the object to be detected has good reflectivity. Moreover, these sensors are likely to give bad results if it is raining. Their use therefore is not advantageous.

Further exemplary embodiments of hands-free access systems comprise capacitive sensors. However, the use of these capacitive sensors is disturbed by the radio communications of the radio frequency antennas. The capacitive sensors may then give erroneous orders to the central unit of the vehicle. A solution to this problem lies in interrupting the electrical power supply to the capacitive sensors during the radio transmissions of the radio frequency antennas, thus rendering the capacitive sensors non-operational during these transmission periods.

Patent application FR 2 915 838 presents a further hands-free access approach and provides the following solution to the disturbance affecting the capacitive sensors as a result of the radio communications. This solution lies in blocking, at the central unit, the signals originating from the capacitive sensors when these signals are transmitted at the same time as the radio signals. In addition to the same disadvantage as in the previous solution with regard to communication interruption, this blocking requires a software modification in the central unit.

This type of method, comprising both radio communications between keys and central unit and wired communications between capacitive sensors and central unit for hands-free access, is illustrated in FIG. 1. Throughout this method, the information transmitted by the capacitive sensors is then stopped during the radio emissions. The method starts with the step of nominal operation 20 called "Start". This step is followed by a step of switching to a low-energy consumption mode "W" 22 of the central unit so as to save the electrical energy of the vehicle, until the presence of an electronic key "K" in the vicinity of the vehicle has been confirmed during the test 26. As long as no electronic key is recognized during the test 26, the method returns to the step Start 20. When the presence of an electronic key is recognized during the test 26, the method switches the central unit into a high-energy consumption mode "W W"—step 28—so as to be able to ensure encrypted identification request dialogue with said electronic key.

The identity request test 30 concerns the success of the encrypted dialogue between the central unit and the electronic key for the identity request "Id?" of this electronic key. If this test is unsuccessful the process returns to the Start 20. If it is successful, that is to say if the identity is effective, the method awaits the detection of a hand by the capacitive sensor (presence detection test 34), then determines whether this detection is validated by the central unit during the test 36. The validation test may relate for example to the fact that the capacitive sensor that has detected a hand is in the same handle as the antenna having detected the electronic key. In the case of a negative response "N" to at least one of these two presence tests 34, 36, the method returns to the Start 20. In the case of a positive response "O" to these two tests, the method terminates at step 38 "End" with the unlocking of the door in question or of all of the doors of the vehicle depending on the parameterization of the method.

However, this type of method has a significant disadvantage: because the capacitive sensors are disturbed during the radio communications, it is advantageous to stop the information transmitted thereby during said radio communications, and this places the user in front of a "wall effect". This wall effect corresponds to an abnormally long period during which the user must grasp the handle of a door before the door is successfully unlocked.

SUMMARY OF THE INVENTION

The embodiments above show that, whatever the solutions adopted, the capacitive sensors involved in the hands-free effect pass through an inactive state repeatedly, that is to say during each radio communication, which causes the wall effect. In order to overcome this disadvantage, the present invention proposes to adapt the frequency of the periods of inactivity of the capacitive sensors so as to cancel the wall effect experienced by the user of the vehicle, or so as to at least decrease the occurrence of this effect significantly.

More specifically, the present invention relates to a method for processing a presence signal in a hands-free vehicle access system having capacitive sensors. This method comprises a step of testing for the presence of a key via an emission of interrogation signals at a regular nominal frequency, this emission being referred to hereinafter as nominal "polling", transmitted via an antenna connected to a central unit installed in the vehicle, a step of testing for an identity request destined for the electronic key and transmitted via an antenna of the central unit, two steps of testing for the presence of a hand, transmitted via a capacitive sensor to the central unit concerning the presence of a hand on a handle, and a final step of authorizing the unlocking of the vehicle.

To improve the responsiveness, the hands-free access method according to the invention additionally comprises, before the steps of testing for the presence of a hand, a step of decreasing the frequency of the signals transmitted via the antenna of the central unit so as to pass into "slow-frequency polling" mode, such that the capacitive sensors have time intervals of sufficient length to be able to test for the presence of a hand and advise the central unit of the result.

This decrease of the frequency of the signals transmitted by the antenna of the central unit advantageously allows the capacitive sensors to have greater availability to signal the presence of a hand. In addition, this lowering of the frequency for transmission of the signals via the radio antenna of the central unit allows an energy saving for the vehicle.

In accordance with the advantageous features, the method according to the invention allows for the following actions:

- an initial step of nominal starting, called Start, is followed by a switching of the central unit to a low-energy consumption mode so as to save the electrical energy of the vehicle;
- the central unit is switched to a high-energy consumption mode after effective identification of an electronic key during the step of testing for an identity request;
- the central unit is switched to a high-energy consumption mode when the response to the step of testing for the presence of a key is positive;
- when the electronic key responds positively to the identity request, the step of interrogating the central unit passes to slow-frequency polling during the testing for the presence of a hand;
- if no capacitive sensor sends information during a presence detection step of the presence test once a predetermined period of time has elapsed, the method returns to the step Start;
- the return to the step Start of nominal operation prompts a return to the polling of an interrogation signal at nominal frequency;
- the vehicle constitutes a sole global signal processing zone for the antennas and capacitive sensors of the hands-free access system;
- the global zone is broken down into a number of signal processing zones for the antennas and sensors of the hands-free access system, thus making it possible to correlate, by zone, the detection via an antenna and via a capacitive system of the hands-free access system;
- if the electronic key is no longer detected in the processing zones once a predetermined period of time has elapsed, the method returns to the step Start;
- the signal processing zones are formed of two side door zones and one vehicle luggage compartment zone; if the electronic key is detected from the luggage compartment zone, the central unit returns to nominal polling.

BRIEF DESCRIPTION OF THE DRAWINGS

Further details, features and advantages of the present invention will become clear upon reading the following non-limiting description, given with reference to the accompanying figures, in which.

DETAILED DESCRIPTION OF THE PREFERRED EMBODIMENTS

Figure 2:
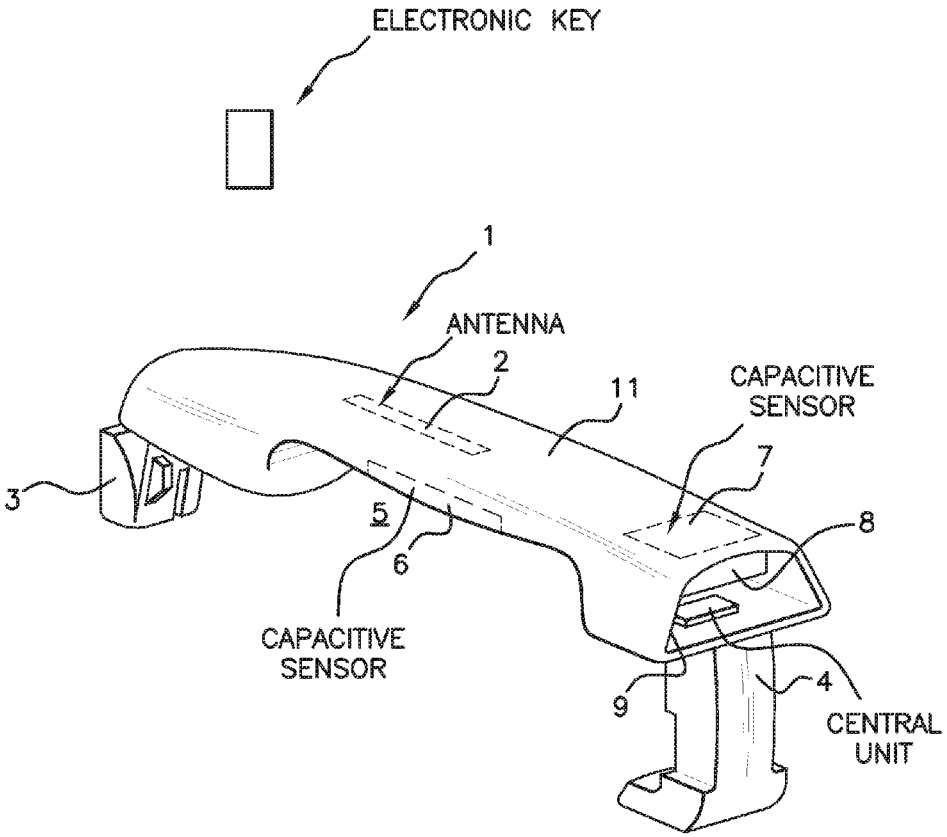
FIG. 2 shows a perspective view of an exemplary door handle of a motor vehicle.

An exemplary embodiment of a vehicle door handle able to carry out the method of the invention and equipped with a capacitive sensor and also a radio frequency antenna connected to a central unit is shown in FIG. 2. The door handle 1 comprises a central part 11 and two fixing ends, one of which 3 is pivotable and the other of which 4 is slidable so as to allow the unlocking of the access point (door or luggage compartment lid—not illustrated). The clearance 5 serves to allow the fingers of a user's hand to pass through.

An antenna 2 allows the reception of radio signals transmitted by an electronic key (not illustrated). A capacitive sensor is also installed in this handle and is composed of two touch detection zones 6 and 7. The zone 6 detects part of a hand passing through the clearance 5 so as to pull on the handle 1, and the zone 7 detects the application of fingers to the surface of this zone 7. The lower part 8 of the zone 7 is visible thanks to the open end 9 of the handle 1. The capacitive sensor and also the antenna 2 are connected to the central unit (not illustrated), installed in the vehicle, via wired electrical connections (not illustrated).

Figure 1:
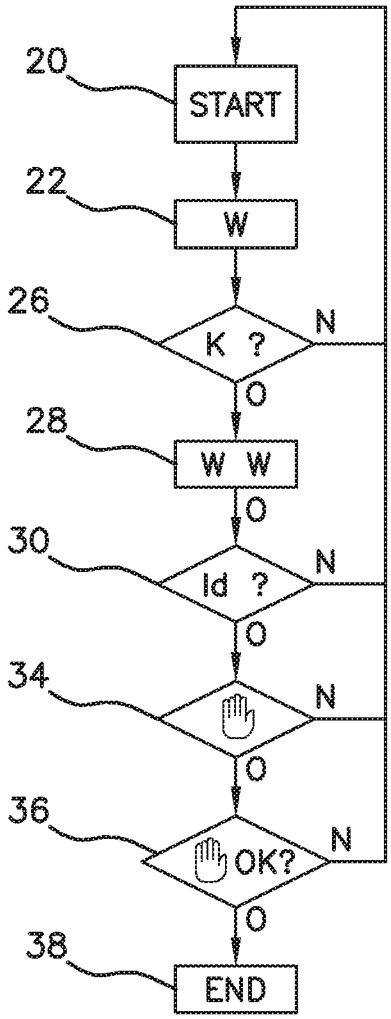
Fig 1 PRIOR ART
FIG. 1 shows an exemplary flow diagram of a hands-free access method according to the prior art (already discussed)
Figure 3:
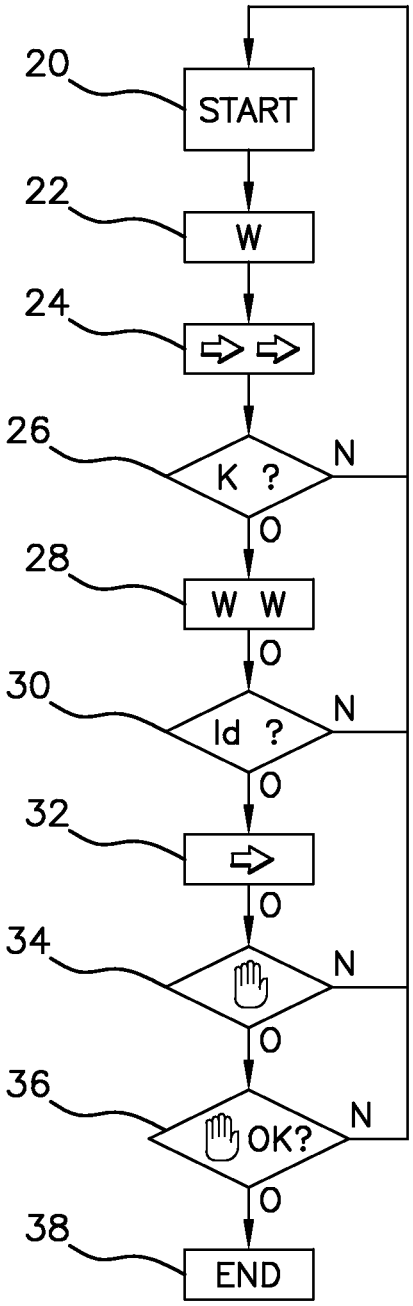
FIG. 3, shows an exemplary flow diagram of a hands-free access method according to the invention.

This handle 1 may typically serve to carry out the exemplary method according to the invention shown in FIG. 3. FIG. 3, more precisely, shows an exemplary flow diagram of a hands-free access method according to the invention. This example includes some features of FIG. 1 of the prior art, denoted by the same reference signs; however, the invention can also be applied to other hands-free method and system variants.

The method starts with the step 20 called Start. This step is followed by a step 22 of switching to a low-energy consumption mode "W" of the central unit so as to save the electrical energy of the vehicle. This step 22 precedes a step of polling an interrogation signal of nominal frequency 24 transmitted by the radio antenna of the central unit.

A testing for the presence of the electronic key 26 is then triggered. As long as no electronic key "K" is recognized in the vicinity of the vehicle during the test 26, the method returns to the step Start 20. When the presence of an electronic key in the vicinity of the vehicle is recognized during the test 26, the method switches the central unit to a high-energy consumption mode "W W" in the step 28 so as to be able to ensure encrypted identity request dialogue 30 with the electronic key.

During this identity request 30, a test concerns the success of the encrypted dialogue between the central unit and the electronic key. If this test fails, the method returns to the step Start 20. If it is successful, the emissions of the radio antenna of the central unit then pass to a slow-frequency polling test 32, for example ⅓ hertz, in place of the nominal polling at increased frequency, for example ten times greater.

This slow-frequency polling, that is to say the transmission of the interrogation signal, makes it possible to provide the capacitive sensor with greater temporal availability, such that it can detect and then signal the presence of a hand on a door handle of the vehicle. The method then awaits, for a predetermined period of 3 seconds, the validation of a detection of a hand (presence detection test 34) by the capacitive sensor. During the test 36, the central unit validates a presence detection with the aid of predefined criteria. In the example, this confirmation concerns the fact that the capacitive sensor, which has detected a hand, is in the same side door handle as the radio frequency antenna that has detected the presence of the electronic key. In the case of a negative response "N" to one of these two presence tests 34, 36, the method returns to its point Start 20. In the case of a positive response "O" to these two tests, the method terminates at step 38 with the unlocking of a door or of all the doors of the vehicle in accordance with an initial parameterization of the method.

The invention is not limited to the described and illustrated exemplary embodiments. Thus, the zone around the vehicle may be divided into different processing zones instead of a global processing zone, as illustrated in the detailed example above. The method then advantageously comprises additional tests concerning the identical nature of the detections performed in the same zone by the capacitive sensors and radio frequency antennas.

The method may allow for additional steps if the electronic key is detected by the radio frequency antenna of the door of the luggage compartment: for example a step in which no return is made to the step Start before a certain delay if no capacitive sensor signals the presence of a hand on a door handle, so as to allow the user time to load the luggage compartment of the vehicle.

In addition, the method can be performed without dialogue encryption.

In addition, the method can be performed without changing the energy level of the central unit.

Also, the method can be supplemented by steps provided so as to detect and defend against interceptions by malicious third-party equipment.

Generally, the method may also be applicable to any system implementing a joint use of sensors sensitive to the radio waves produced repeatedly by equipment in the vicinity of these sensors.

The invention claimed is:

1. A method for processing a presence signal in a hands-free vehicle access system having a capacitive sensor and an antenna fitted in a door handle of said vehicle and connected to a central unit, comprising:

a step of testing for the presence of an electronic key (26) via an emission of an interrogation signal at a regular nominal frequency, this emission being referred to as nominal "polling", transmitted via the antenna connected to the central unit installed in the vehicle, a step of testing for an identity request (30) destined for the electronic key and transmitted via said antenna of the central unit, and, if the test for an identity request is successful:

two steps of testing for the presence of a hand (34, 36):

a presence detection test (34) by the capacitive sensor, and a validation test (36) by the central unit to validate whether the capacitive sensor is in the same door handle as said antenna, and a final step of authorizing the unlocking (38) of the vehicle, wherein, if the test for an identity request is not successful, the method returns to the step of testing for the presence of the electronic key, and wherein, before the two steps of testing for the presence of a hand (34, 36), said method comprises a step of decreasing the frequency of said interrogation signal transmitted via the antenna of the central unit so as to pass into slow-frequency "polling" mode (32), in which the frequency is ten-times lower than the regular nominal frequency.

2. The processing method according to claim 1, wherein an initial start step (20) is followed by a switching of the central unit to a low-energy consumption mode (22).

3. The processing method according to claim 1, wherein the central unit is switched to a high-energy consumption mode (28) after effective identification of an electronic key during the step of testing for an identity request (30).

4. The processing method according to claim 1, wherein the central unit is switched to a high-energy consumption mode (28) when the response to the step of testing for the presence of a key (26) is positive.

5. The processing method according to claim 1, wherein if there is no validation of detection of a hand by the capacitive sensor during the presence detection step (34) for a predetermined period, the method returns to the step of testing for the presence of the electronic key (26).

6. The processing method according to claim 1, wherein the return to the step of testing for the presence of the electronic key (26) prompts a return to a polling of an interrogation signal at the nominal frequency (24).

7. The processing method according to claim 1, wherein the vehicle constitutes a signal processing zone for the antenna and for the capacitive sensor of the hands-free vehicle access system.

8. The processing method according to claim 7, wherein the global zone is broken down into a number of signal processing zones for the antenna and for the capacitive sensor of the hands-free vehicle access system.

9. The processing method according to claim 7, wherein if the electronic key is no longer detected in the signal processing zone once a predetermined period of time has elapsed, the method returns to the step of testing for the presence of the electronic key (26).

10. The processing method according to claim 7, wherein the signal processing zones are formed of two side door zones and one vehicle luggage compartment zone; if the electronic key is detected from the luggage compartment zone, the central unit returns to the step of testing for the presence of the electronic key (26).

11. The processing method according to claim 8, wherein if the electronic key is no longer detected in the signal processing zone once a predetermined period of time has elapsed, the method returns to the step of testing for the presence of the electronic key (26).

12. The processing method according to claim 8, wherein the signal processing zones are formed of two side door zones and one vehicle luggage compartment zone; if the electronic key is detected from the luggage compartment zone, the central unit returns to the step of testing for the presence of the electronic key (26).

13. The processing method according to claim 9, wherein the signal processing zones are formed of two side door zones and one vehicle luggage compartment zone; if the electronic key is detected from the luggage compartment zone, the central unit returns to the step of testing for the presence of the electronic key (26).

14. The processing method according to claim 2, wherein the central unit is switched to a high-energy consumption mode (28) after effective identification of an electronic key during the step of testing for an identity request (30).

15. The processing method according to claim 2, wherein the central unit is switched to a high-energy consumption mode (28) when the response to the step of testing for the presence of a key (26) is positive.

16. The processing method according to claim 2, wherein, if there is no validation of detection of a hand by the capacitive sensor during the presence detection step (34) for a predetermined period, the method returns to the step of testing for the presence of the electronic key (26).

* * * * *